US009917396B2

(12) United States Patent
Horiuchi et al.

(10) Patent No.: US 9,917,396 B2
(45) Date of Patent: Mar. 13, 2018

(54) DEVICE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kanji Horiuchi, Mie (JP); Atsushi Okuda, Mie (JP); Noriyuki Uematsu, Mie (JP); Yoshitomo Tsujii, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/509,703

(22) PCT Filed: Sep. 8, 2015

(86) PCT No.: PCT/JP2015/075381
§ 371 (c)(1),
(2) Date: Mar. 8, 2017

(87) PCT Pub. No.: WO2016/052088
PCT Pub. Date: Apr. 7, 2016

(65) Prior Publication Data

US 2017/0302019 A1 Oct. 19, 2017

(30) Foreign Application Priority Data

Sep. 29, 2014 (JP) ..... 2014-197861

(51) Int. Cl.
*H01R 4/64* (2006.01)
*H01R 13/502* (2006.01)
*H01R 13/52* (2006.01)

(52) U.S. Cl.
CPC ..... *H01R 13/5227* (2013.01); *H01R 13/5202* (2013.01)

(58) Field of Classification Search
CPC .... H01R 13/5202; H01R 13/60; H01R 13/74; H01R 13/516; H01R 13/5219;
(Continued)

(56) References Cited

U.S. PATENT DOCUMENTS 9,083,107 B2 * 7/2015 Suzuki ..... H01R 13/5219
9,379,481 B2 * 6/2016 Kashiwada ..... H01R 13/5213
(Continued)

FOREIGN PATENT DOCUMENTS

CN 103840304 6/2014
JP 10-199611 7/1998
(Continued)

OTHER PUBLICATIONS

International Search Report dated Dec. 8, 2015.

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A device connector (10) is mounted into a mounting hole (C1) on a case (C) of a device in a vehicle, and includes terminals (50) connected to wires (W). A synthetic resin housing (30) includes a wire introducing portion (32) and a fitting portion (31). The wire introducing portion (32) receives the wires (W) and the terminals (50) while the fitting portion (31) fits into the mounting hole (C1). A metal shield shell (60) accommodates the wire introducing portion
(Continued)

(32) and includes a lower shell (62) for covering the entire outer circumferential surface of the wire introducing portion (32). A seal ring (72) fits on an outer surface of the wire introducing portion (32) and seals between the lower shell (62) and the wire introducing portion (32). Water drainage holes (77) vertically penetrate a stepped portion (69) of the lower shell (62) above the seal ring (72).

10 Claims, 3 Drawing Sheets

(58) Field of Classification Search
CPC ..... H01R 13/6596; H01R 13/4436; H01R 13/745; H01R 13/748; H01R 13/5227; H01R 24/76; H01R 4/64; H02G 3/22; H02G 15/007; H02G 15/013
USPC ..... 439/686, 205, 206, 362–364, 587–589, 439/159, 559, 538, 271
See application file for complete search history.

(56) References Cited

U.S. PATENT DOCUMENTS

| | | | | |
|---|---|---|---|---|
| 9,385,516 | B2 * | 7/2016 | Tanaka | H02G 3/22 |
| 2007/0141904 | A1 * | 6/2007 | Hayashi | H01R 13/5208 439/587 |
| 2010/0261364 | A1 * | 10/2010 | Matsuoka | H01R 13/5202 439/271 |
| 2012/0100753 | A1 * | 4/2012 | Omae | H01R 13/5202 439/588 |
| 2013/0316573 | A1 * | 11/2013 | Uno | H01R 11/12 439/573 |
| 2014/0024266 | A1 * | 1/2014 | Kashiwada | H01R 13/6315 439/686 |
| 2014/0120767 | A1 * | 5/2014 | Itsuki | H01R 13/5208 439/587 |

FOREIGN PATENT DOCUMENTS

| | | |
|---|---|---|
| JP | 2014-86350 | 5/2014 |
| JP | 2014-107043 | 6/2014 |

* cited by examiner

DEVICE CONNECTOR

BACKGROUND

1. Field of the Invention

This specification relates to a device connector.

2. Description of the Related Art

Japanese Unexamined Patent Publication No. 2014-107043 discloses a device connector to be mounted into a mounting hole provided on a case of a device to be installed in a vehicleei1073. This device connector includes a housing with a fitting portion provided on a front surface and a shield body. The fitting portion is fittable into a mounting hole of a case and the shield body is to be fixed to the case of the device while covering an outer surface of the housing. The housing is provided with a draw-out portion for pulling out wires in a downward direction intersecting with a fitting direction of the fitting portion. The shield body is fixed to the housing while exposing the front surface of the housing. The device connector is fixed to the case by inserting a bolt through a fixing portion provided on a side surface of the shield body and tightening the bolt into the case.

It may be necessary to cover the front surface of the housing as much as possible by the shield body to improve shielding performance. In this situation, it is thought to form a lower end part of the shield body into a tubular shape and to cover the entire outer surface of the draw-out portion over the entire circumference by this tubular part. However, if the entire outer surface of the draw-out portion is covered over the entire circumference by the tubular part, water may intrude between the tubular part and the draw-out portion. This water may pool inside the shield body and may intrude into the interior of the case through the mounting hole, such as by moving along the device connector when the device connector is detached from the mounting hole of the case.

A technique for suppressing the pooling of water in a shield member, such as a shield body, is disclosed in this specification.

SUMMARY

This specification is directed to a device connector to be mounted into a mounting hole provided on a case of a device to be installed in a vehicle. The device connector includes a terminal connected to an end of a wire. The device connector also has a housing made of synthetic resin and including a wire introducing portion into which the wire is to be introduced together with the terminal. The housing is fittable into the mounting hole. The device connector further includes a shield shell made of metal and configured to accommodate the wire introducing portion inside. The shield shell has a tubular portion for covering an outer peripheral surface of the wire introducing portion over the entire circumference. A seal member is fit on an outer surface of the wire introducing portion and is configured to seal between the tubular portion and the wire introducing portion. A water drainage hole penetrates through a wall of the tubular portion at a position closer to a side where the wire introducing portion is to be accommodated than the seal member.

According to this device connector, even if water intrudes into the tubular portion, such as through an opening on the side where the wire introducing portion is to be accommodated, the water in the tubular portion can be discharged through the water drainage hole. Thus, the intrusion of water into the case can be prevented when detaching the device connector from the mounting hole of the case.

The device connector may further include a fitting bolt configured to fit the housing into the mounting hole by being penetrated through the wire introducing portion and the tubular portion and tightened into the case. A waterproof cover may be mounted on an outer surface of the tubular portion and may be configured to cover a shield conductor connected to an edge part of another side opening on a side opposite to one side opening of the tubular portion through which the wire introducing portion is to be accommodated. The seal member may be arranged closer to the other side opening than the position of the fitting bolt. According to this configuration, water having intruded into the tubular portion tends to be pooled in the tubular portion by penetrating the fitting bolt through the tubular portion while making the shield conductor waterproof. Thus, it is very effective to provide the water drainage hole.

A plurality of the water drainage holes may be formed on an outer periphery of the wire introducing portion while being spaced apart. According to this configuration, even if water intrudes at any position of the wire introducing portion and the tubular portion, the water in the tubular portion can be discharged through the respective water drainage holes.

The water drainage hole may be arranged outside an entrance path of the seal member in the tubular portion by being provided on a part made wider than a part to be contacted by the seal member in the tubular portion. According to this configuration, the seal member can be prevented from being damaged by contacting an opening edge of the water drainage hole when accommodating the wire introducing portion into the tubular portion.

The tubular portion may be mounted around the wire introducing portion that has an upward opening through which the wire introducing portion is to be accommodated. The water drainage hole may vertically penetrate through a bottom part of an enlarged diameter portion that is enlarged in diameter right above a part to be contacted by the seal member in the tubular portion. According to this configuration, water blocked on a bottom plate of an enlarged diameter portion by the seal member can be discharged quickly down through the water drainage hole. Further, since the tubular portion is not exposed through the water drainage hole, a reduction of shielding performance in the tubular portion can be suppressed.

The tubular portion may be mounted around the wire introducing portion with the upward opening through which the wire introducing portion is to be accommodated. The water drainage hole may open laterally along a bottom part of an enlarged diameter portion enlarged in diameter right above a part to be contacted by the seal member in the tubular portion. According to this configuration, water blocked on the bottom plate of the enlarged diameter portion by the seal member can be discharged quickly in the lateral direction through the water drainage hole.

According to the invention, it is possible to suppress the pooling of water in a shield member.

DETAILED DESCRIPTION

Figure 1:
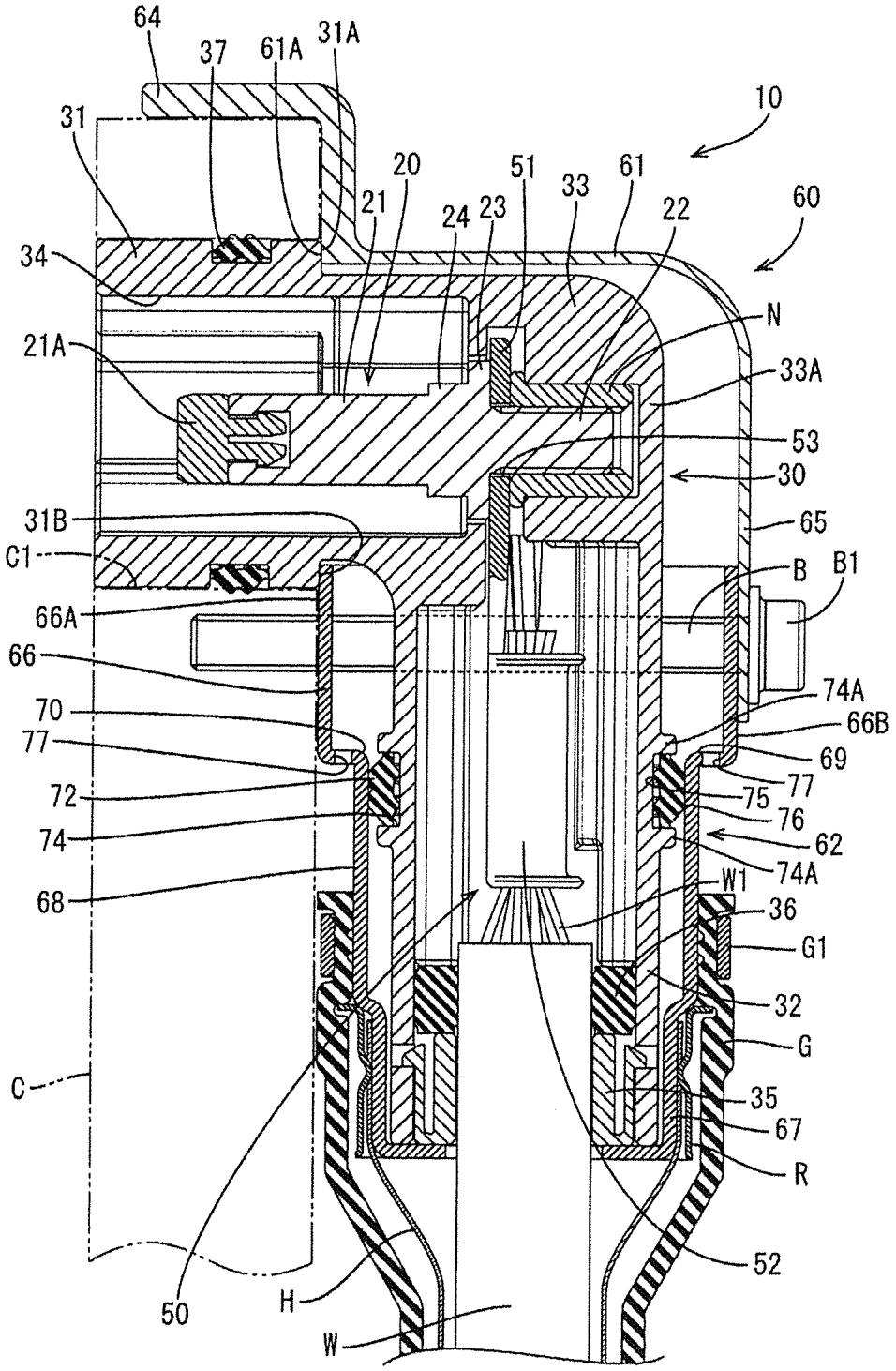
FIG. 1 is a section of a device connector of a first embodiment.
Figure 2:
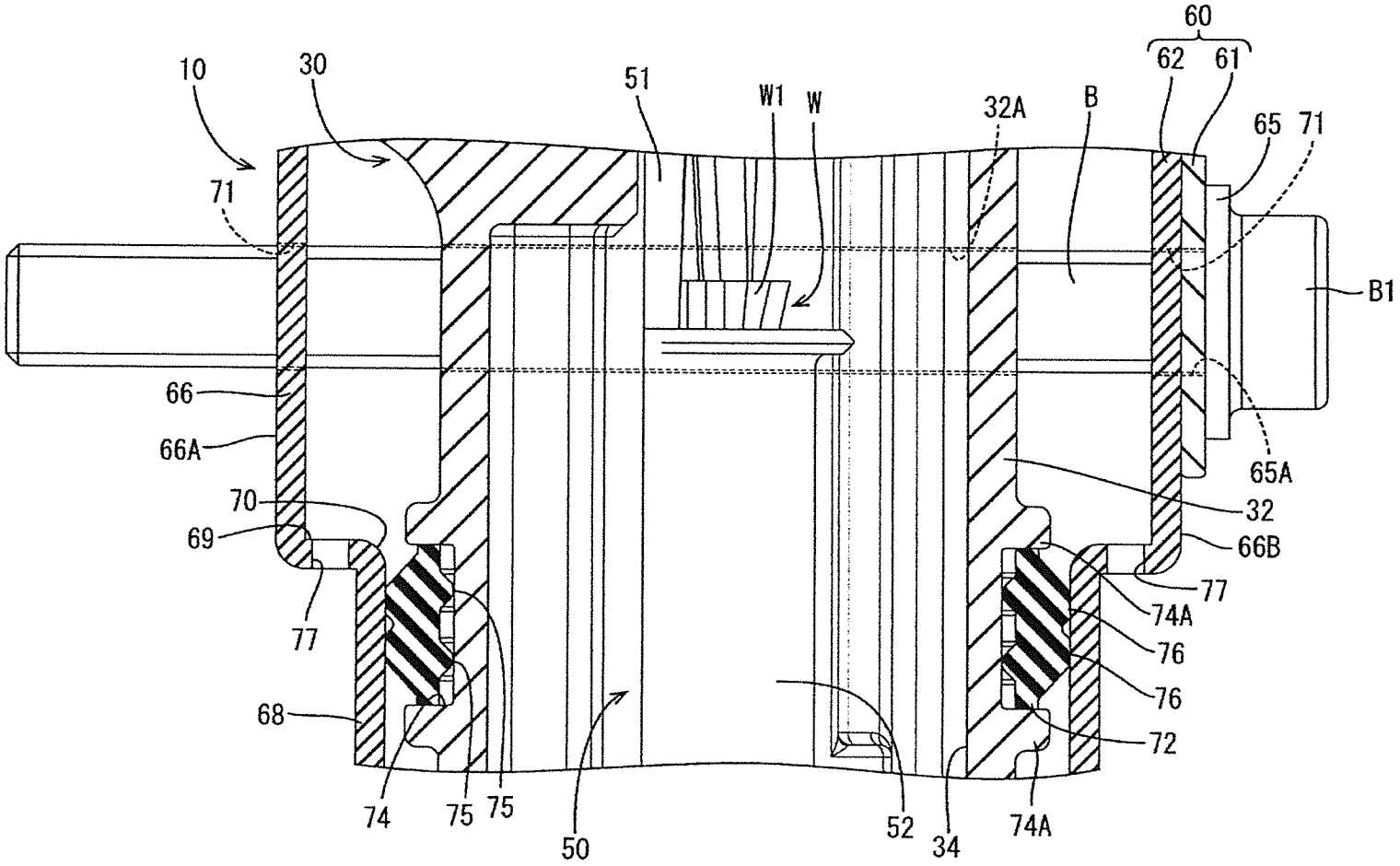
FIG. 2 is an enlarged section of a main part of FIG. 1.

FIGS. 1 and 2 illustrate a first embodiment of a device connector 10 to be mounted into a mounting hole C1 provided on a case C of a device to be installed in a vehicle. Note that, in the following description, a vertical direction is based on FIG. 1. Further, a left side and a right side shown in FIG. 1 are referred to as a front side and a rear side concerning a front-back direction.

The device connector 10 includes male terminals 20 connectable to unillustrated female terminals of a device-side connector provided in the case C of the device. The device connector 10 also includes a housing 30 made of synthetic resin and configured to accommodate a pair of male terminals 20 arranged in a width direction. Intermediate terminals (an example of a "terminal") 50 are connected to the male terminals 20 in the housing 30 while being connected to ends of wires W. A shield shell 60 made of metal is configured to cover the housing 30.

The male terminal 20 is made of metal excellent in conductivity and is formed into a substantially cylindrical shape long in the front-back direction, as shown in FIG. 1. A cylindrical connecting portion 21 is formed at a front part of the male terminal 20 before a substantially central part in the front-back direction. The connecting portion 21 is to be connected to the female terminal of the device-side connector. A substantially cylindrical protection cap 21A made of synthetic resin is mounted on the front end of the cylindrical connecting portion 21.

A rear end part of the male terminal 20 is formed into an externally threaded portion 22 having a screw thread formed on an outer peripheral surface, and the male terminal 20 is fixed in the housing 30 by fastening this externally threaded portion 22 to a nut N embedded in the housing 30 to be described later.

A circular and radially protruding flange 23 is provided between the cylindrical connecting portion 21 and the externally threaded portion 22. A rectangular tool mounting portion 24 is provided on the front surface of the flange 23 for mounting a tool in fastening the externally threaded portion 22 to the nut N of the housing 30.

The housing 30 is substantially L-shaped and includes a fitting portion 31 to be fit into the mounting hole C1 of the case C, a wire introducing portion 32 into which the wires W are to be introduced together with the intermediate terminals 50 from below and a coupling portion 33 coupling the fitting portion 31 and the wire inserting portion 32 into a substantially L shape.

The fitting portion 31 is formed into a substantially hollow cylindrical shape somewhat wide in a lateral direction, and open forward. A seal ring 37 is fit on the outer peripheral surface of the fitting portion 31. This seal ring 37 is held in close contact with the inner peripheral surface of the mounting hole C1 and the outer peripheral surface of the fitting portion 31 over the entire circumference to prevent the intrusion of water and the like into the interior of the case C through the mounting hole C1 when the fitting portion 31 is fit into the mounting hole C1 of the case C.

The coupling portion 33 is formed into a box shape smaller than the fitting portion 31 in the vertical direction, and both upper and lower end parts of the fitting portion 31 vertically project more than the coupling portion 33.

The wire inserting portion 32 is somewhat wide in the lateral direction and long in the vertical direction, and opens downward. A rubber plug 36 retained by a rubber plug pressor 35 is mounted in a lower end part of the wire inserting portion 32. This rubber plug 36 prevents the intrusion of water and the like into the interior of the wire inserting portion 32 through a lower end opening of the wire inserting portion 32 by being held in close contact with the inner peripheral surface of the wire inserting portion 32 and the outer peripheral surfaces of the wires W introduced into the wire inserting portion 32.

A fitting bolt insertion hole 32A penetrates in the front-back direction in an upper end part of the wire inserting portion 32, and a fitting bolt B for fitting the fitting portion 31 into the mounting hole C1 can be inserted through this fitting bolt insertion hole 32A and tightened into the case C.

Further, two substantially L-shaped cavities 34 are provided side by side in the width direction inside the housing 30 and extend from a front end opening of the fitting portion 31 to the lower end opening of the wire inserting portion 32 through the coupling portion 33.

A part of the cavity 34 provided from the fitting portion 31 to the coupling portion 33 is a space extending straight in the front-back direction, and the nuts N made of metal are embedded in a rear wall 33A of the cavity 34 in the coupling portion 33. Each nut N is fixed to the coupling portion 33 while being open in the front-back direction, and the male terminal 20 is held in the part of the cavity 34 formed from the fitting portion 31 to the coupling portion 33 by tightening the externally threaded portion 22 of the male terminal 20 through the front end opening of the nut N.

A part of the cavity 34 provided from the wire introducing portion 32 to the coupling portion 33 is a space vertically extending straight and the wire W is introduced together with the intermediate terminal 50 into this part of the cavity 34 along the cavity 34.

The intermediate terminal 50 is formed by press-working a metal material excellent in conductivity, and is vertically long. Further, the intermediate terminal 50 is formed such that a wire connecting portion 52 is connected below a terminal fastening portion 51 in the form of a flat plate, and connected to an upper end part of the wire W by crimping the wire connecting portion 52 to a core W1 exposed at the end of the wire W.

A through hole 53 open forward and backward penetrates through the terminal fastening portion 51. The terminal fastening portion 51 is arranged on the front surface of the nut N of the coupling portion 33 such that this through hole 53 is coaxial with the nut N, and the externally threaded portion 22 of the male terminal 20 is inserted through the through hole 53 and tightened into the nut N. Thus, the male terminal 20 and the wire W are connected electrically via the intermediate terminal 50.

The shield shell 60 is formed such as by press-working or drawing a metal material excellent in conductivity and configured by assembling an upper shell 61 for covering the outer surface of the coupling portion 33 and a lower shell (an example of a "tubular portion") 62 for covering the outer surface of the wire introducing portion 32 with each other.

The upper shell 61 is formed into a box shape open forward and downward and completely covers four surfaces of the coupling portion 33, i.e. upper, rear and opposite widthwise side surfaces. An upper part 61A of a front opening edge of the upper shell 61 contacts an upper rear surface 31A of the fitting portion 31 when the upper shell 61 is assembled with the housing 30. Further, a fixing piece 64 extends up and then forward from the upper part 61A of the upper shell 61, and an insertion hole 65A penetrates a lower end part of a rear surface 65 of the upper shell 61 in a plate thickness direction to be open forward and backward.

The lower shell 62 is formed into a substantially hollow cylindrical shape enlarged in diameter in two stages toward an upper side, and the wire introducing portion 32 can be accommodated into the lower shell 62 through an upper end opening, which is a first side opening of the lower shell 62.

The lower shell 62 is assembled with the housing 30 while the wire introducing portion 32 is accommodated therein from above, and an upper end part of the lower shell 62 serves as an upper shell fitting portion (an example of an "enlarged diameter portion") 66 to be fit into a lower end part of the upper shell 61 assembled with the housing 30 in the process of assembling the lower shell 62. Further, when the lower shell 62 is assembled with the housing 30, a front surface 66A on an upper end part of the upper shell fitting portion 66 contacts a lower end rear surface 31B of the fitting portion 31 and two of the wires W are pulled out down through a lower end opening, which is the second side opening of the lower shell 62.

A lower end part of the lower shell 62 serves as a shield connecting portion 67 formed to have a smallest diameter in the lower shell 62. A braided wire (an example of a "shield conductor") H for collectively covering the wires W pulled out down from the lower shell 62 is connected to the outer peripheral surface of the shield connecting portion 67 by a caulking ring R.

A substantially vertical central part of the lower shell 62 defines a cover mounting portion 68 having a smaller diameter than the upper shell fitting portion 66 and having a slightly larger diameter than the shield connecting portion 67. A stepped portion (an example of a "wall portion") 69 protrudes radially from an upper end part of the cover mounting portion 68 and is coupled to a lower end part of the upper shell fitting portion 66. The stepped portion 69 is provided over the entire circumference between a side wall 66C of the upper shell fitting portion 66 and the cover mounting portion 68. Additionally, the stepped portion 69 constitutes a bottom part of the upper shell fitting portion 66. Further, an inner surface in a boundary part between the stepped portion 69 and the cover mounting portion 68 is formed into a rounded and smooth curved surface 70.

A rubber boot (an example of a "waterproof cover") G covers the outer surfaces of the braided wire H and the caulking ring R is fixed to the outer peripheral surface of the cover mounting portion 68 by a fixing band G1. The rubber boot G waterproofs the braided wire H and a contact part between the braided wire H and the lower shell 62.

Further, each of the front surface 66A and a rear surface 66B of the upper shell fitting portion 66 in the lower shell 62 is provided with a bolt insertion hole 71. The fitting bolt B is inserted through these bolt insertion holes 71 as well as the insertion hole 65A of the upper shell 61 and the fitting bolt insertion hole 32A of the wire introducing portion 32. The fitting bolt B inserted through these insertion holes 32A, 54A and 71 can be tightened into the case C to hold the fitting portion 31 in the mounting hole C1 of the case C while integrally fixing the upper shell 61 and the lower shell 62.

Specifically, the fitting bolt B is inserted through the respective insertion holes 32A, 54A and 71 and tightened into the case C. Thus, the head B1 of the fitting bolt B presses the upper shell 61 forward, and the upper end rear surface 31A of the fitting portion 31 is pressed forward as the upper end part 61A on the front end opening edge of the upper shell 61 is pressed forward. Further, the upper shell fitting portion 66 of the lower shell 62 is pressed forward by the rear surface 65 of the upper shell 61, and the lower end rear surface 31B of the fitting portion 31 is pressed forward by the front surface 66A on the upper end part of the upper shell fitting portion 66. In this way, the fitting bolt B presses the fitting portion 31 forward via the shield shell 60 and the fitting portion 31 is fit easily into the mounting hole C1 of the case C.

An annular seal ring (an example of a "seal member") 72 is mounted on the outer peripheral surface of a substantially vertical central part of the wire introducing portion 32 for stopping water between the cover mounting portion 68 of the lower shell 62 and the wire introducing portion 32, and a plurality of water drainage holes 77 are provided on the stepped portion 69 provided between the upper shell fitting portion 66 and the cover mounting portion 68.

The seal ring 72 has a flat cross-sectional shape extending along the outer peripheral surface of the wire introducing portion 32, and is mounted in a mounting recess 74 provided on the outer peripheral surface of the wire introducing portion 32.

The mounting recess 74 is configured by two ribs 74A radially protruding over the entire circumference from the outer peripheral surface of the wire introducing portion 32 and the outer peripheral surface of the wire introducing portion 32 between the two ribs 74A. When the seal ring 72 is mounted into the mounting recess 74, inner peripheral lips 75 circumferentially provided on the inner peripheral surface of the seal ring 72 are held in close contact with the outer peripheral surface of the wire introducing portion 32.

Radially protruding outer peripheral lips 76 are provided circumferentially on the outer peripheral surface of the seal ring 72. These outer peripheral lips 76 are set to have an outer diameter slightly larger than an inner diameter of the cover mounting portion 68, and are held in close contact with the inner peripheral surface of the upper end of the cover mounting portion 68 when the wire introducing portion 32 is accommodated into the lower shell 62. That is, when the lower shell 62 is assembled with the housing 30, the outer peripheral lips 76 of the seal ring 72 are held in close contact with the inner peripheral surface of the upper end of the cover mounting portion 68 and the inner peripheral lips 75 of the seal ring 72 are held in close contact with the outer peripheral surface of the wire introducing portion 32, thereby preventing downward intrusion of water from between the cover mounting portion 68 and the wire introducing portion 32.

Water drainage holes 77 penetrate through the stepped portion 69 in a plate thickens direction, which is the vertical direction, and are formed at positions to surround the wire introducing portion 32 while being circumferentially spaced apart. In other words, the water drainage holes 77 are formed and arranged outside an entrance path of the seal ring 72 in accommodating the wire introducing portion 32 into the lower shell 62 and in a bottom part of the upper shell fitting portion 66 enlarged in diameter and provided right above the cover mounting portion 68 to surround the wire introducing portion 32. Further, the water drainage holes 77 vertically penetrate through the stepped portion 69 so that the wire introducing portion 32 accommodated in the lower shell 62 is not exposed through the water drainage holes 77.

This embodiment is configured as described above. Next, the procedure of mounting and detaching the device connector 10 on and from the case C of the device is described and functions and effects of the device connector 10 are described.

In mounting the device connector 10 on the case C of the device, a front end part of the fitting portion 31 is fit lightly into the mounting hole C1 of the case C. Then, the fitting bolt B successively inserted through the insertion hole 65A of the upper shell 61, the rear bolt insertion hole 71 of the lower shell 62, the fitting bolt insertion hole 32A of the wire introducing portion 32 and the front bolt insertion hole 71 of the lower shell 62 in this order from behind the upper shell 61 is tightened into the case C.

In this process of tightening the fitting bolt B, the rear surface 65 of the upper shell 61 is pressed forward by the head B1 of the fitting bolt B, and the upper end rear surface 31A of the fitting portion 31 is pressed forward by the upper end part 61A on the front opening edge of the upper shell 61 being pressed forward. Further, the upper shell fitting portion 66 of the lower shell 62 is pressed forward by the rear surface 65 of the upper shell 61, and the lower end rear surface 31B of the fitting portion 31 is pressed forward by the front surface 66A of the upper shell fitting portion 66. That is, tightening the fitting bolt B into the case C presses the fitting portion 31 forward, via the shield shell 60, and into the mounting hole C of the case C. In this way, the device connector 10 is mounted on the case C of the device.

Further, in detaching the device connector 10 from the case C of the device, the fitting bolt B tightened into the case C is loosened and the fitting portion 31 is separated from the mounting hole C1 to separate the device connector 10 from the case C of the device. In this way, the device connector 10 is detached from the case C of the device.

Water or the like that splashes on the device connector 10 with the device connector 10 mounted on the case C of the device may intrude into the upper shell fitting portion 66 through a clearance between the upper shell 61 and the lower shell 62 and the bolt insertion holes 71 provided in the upper shell fitting portion 66 of the lower shell 62. If the device connector 10 is detached from the case C of the device with water pooled in the upper shell fitting portion 66, the water pooled in the upper shell fitting portion 66 may intrude into the case C from the mounting hole C1 by moving along the surface of the device connector 10 or the like.

However, according to this embodiment, even if water intrudes into the upper shell fitting portion 66 through the clearance between the upper shell 61 and the lower shell 62 and the bolt insertion holes 71 provided in the upper shell fitting portion 66 of the lower shell 62, the water in the upper shell fitting portion 66 can be discharged quickly down through the water drainage holes 77 on the stepped portion 69. In this way, the intrusion of water into the case C can be prevented when detaching the device connector 10 from the mounting hole C1 of the case C.

That is, if it is necessary to provide the upper shell fitting portion 66 of the lower shell 62 with the bolt insertion holes 71, through which the fitting bolt B is to be inserted, as in this embodiment, water tends to be pooled in the upper shell fitting portion 66. However, water in the upper shell fitting portion 66 can be discharged quickly through the water drainage holes 77 on the stepped portion 69, which is very effective.

Further, according to this embodiment, the water drainage holes 77 are provided around the wire introducing portion 32 so as not to expose the wire introducing portion 32 accommodated in the lower shell 62. Thus, water in the upper shell fitting portion 66 can be discharged quickly through the water drainage holes 77 while a reduction of shielding performance in the lower shell 62 is suppressed.

Further, the water drainage holes 77 penetrate through the lower shell 62 on the stepped portion 69 that is the bottom part of the upper shell fitting portion 66 and is wider than the cover mounting portion 68 at a position where the seal ring 72 is held in close contact. Additionally, the inner surface of the boundary part between the stepped portion 69 and the cover mounting portion 68 is formed into the rounded and smooth curved surface 70. Thus, in the process of accommodating the wire introducing portion 32 into the lower shell 62 and holding the outer peripheral lips 76 of the seal ring 72 in close contact with the inner peripheral surface of the cover mounting portion 68, the outer peripheral lips 76 of the seal ring 72 can be prevented from being damaged such as due to contact with the opening edges of the water drainage holes 77 and the like.

Figure 3:
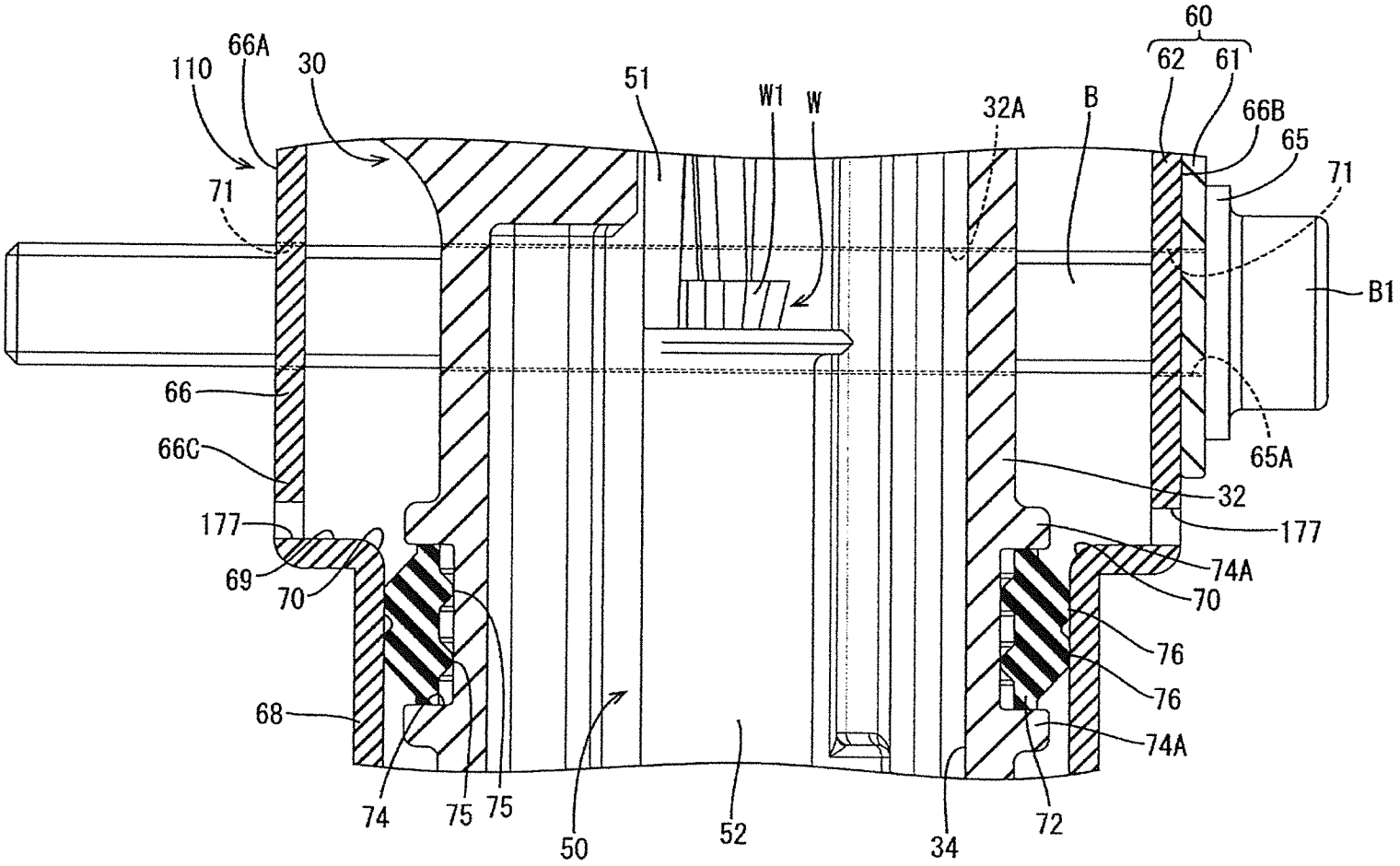
FIG. 3 is an enlarged section, corresponding to a cross-section of FIG. 1, of a device connector according to a second embodiment.

Next, a second embodiment is described with reference to FIG. 3.

In a device connector 110 of the second embodiment, the positions of the water drainage holes 77 of the lower shell 62 in the first embodiment are changed. Components, functions and effects common to the first embodiment are not repeatedly described. Further, the same reference signs are used to denote the same components as in the first embodiment.

A water drainage hole 177 of the second embodiment is formed to laterally penetrate through a side wall (an example of the "wall portion") 66C of an upper shell fitting portion 66 and a lower end opening edge of the water drainage hole 177 is laterally open to be flush with the upper surface of a stepped portion 69. That is, the water drainage hole 177 is provided on a lower end part of the upper shell fitting portion 66 as in the first embodiment. Further, also in this embodiment, a plurality of the water drainage holes 177 are formed to surround a wire introducing portion 32 while being circumferentially spaced apart.

Specifically, according to this embodiment, water blocked on the stepped portion 69 by a seal ring 72 quickly can be discharged laterally through the water drainage holes 177. In this way, the intrusion of water into the case C can be prevented when detaching the device connector 110 from the mounting hole C1 of the case C. Further, according to this embodiment, when the device connector 110 is inclined slightly, water in the upper shell fitting portion 66 can be discharged quickly from a lower end part of the upper shell fitting portion 66 through the water drainage hole 177 on an inclined side.

The invention is not limited to the above described and illustrated embodiments and includes, for example, the following various modes.

In the above embodiments, the upper shell fitting portion 66 of the lower shell 62 is provided with the bolt insertion holes 71 through which the fitting bolt B is to be inserted, and the seal ring 72 is arranged below the bolt insertion hole 71. However, there is no limitation to this. The invention can also be applied to device connectors in which a seal ring cannot be arranged on an upper end opening edge part of a lower shell and water intrudes into the lower shell.

In the above embodiments, the stepped portion 69 is configured to protrude radially. However, there is no limitation to this and the stepped portion may be configured to incline up as it protrudes radially out.

The water drainage holes 77 are open down in the first embodiment and the water drainage holes 177 are open laterally in the second embodiment. However, there is no limitation to this and the water drainage holes may be open in an oblique direction in the boundary part between the side wall of the upper shell fitting portion and the stepped portion.

LIST OF REFERENCE SIGNS

10: device connector
30: housing
32: wire introducing portion
50: intermediate terminal (terminal)
60: shield shell
62: lower shell (tubular portion)
66: upper shell fitting portion (enlarged diameter portion)
66C: side wall (wall portion)

69: stepped portion (wall portion)
72: seal ring (seal member)
B: fitting bolt
C: case
C1: mounting hole
G: rubber boot (waterproof cover)
H: braided wire (shield conductor)
W: wire

The invention claimed is:

1. A device connector to be mounted into a mounting hole provided on a case of a device to be installed in a vehicle, comprising:

a terminal connected to an end of a wire;

a housing made of synthetic resin, including a wire introducing portion into which the wire is to be introduced together with the terminal, and fittable into the mounting hole;

a shield shell made of metal, configured to accommodate the wire introducing portion inside and including a tubular portion for covering an outer peripheral surface of the wire introducing portion over the entire circumference;

a seal member configured to seal between the tubular portion and the wire introducing portion by being fitted on an outer surface of the wire introducing portion, the seal member being mounted in a mounting recess provided on the wire introducing portion; and the tubular portion having a first side where the wire introducing portion is to be accommodated and a second side opposite to the first side, the tubular portion including a water drainage hole penetrating through a wall of the tubular portion at a position lateral to an end part of the first side of the mounting recess.

2. The device connector of claim 1, further comprising:

a fitting bolt configured to fit the housing into the mounting hole by being penetrated through both the wire introducing portion and the tubular portion and tightened into the case; and a waterproof cover mounted on an outer surface of the tubular portion and configured to cover a shield conductor connected to an edge part of another side opening on a side opposite to first side opening of the tubular portion through which the wire introducing portion is to be accommodated, the seal member being closer to the second side opening than the position of the fitting bolt.

3. The device connector of claim 2, wherein a plurality of the water drainage holes are formed on an outer periphery of the wire introducing portion while being spaced apart.

4. The device connector of claim 3, wherein the water drainage hole is arranged outside an entrance path of the seal member in the tubular portion by being provided on a part made wider than a part to be contacted by the seal member in the tubular portion.

5. The device connector of claim 4, wherein:

the tubular portion is mounted around the wire introducing portion with one upward opening, through which the wire introducing portion is to be accommodated; and the water drainage hole vertically penetrates through a bottom part of an enlarged diameter portion enlarged in diameter right above a part to be contacted by the seal member in the tubular portion.

6. The device connector of claim 4, wherein:

the tubular portion is mounted around the wire introducing portion with one upward opening, through which the wire introducing portion is to be accommodated; and the water drainage hole is open laterally along a bottom part of an enlarged diameter portion enlarged in diameter right above a part to be contacted by the seal member in the tubular portion.

7. The device connector of claim 1, wherein a plurality of the water drainage holes are formed on an outer periphery of the wire introducing portion while being spaced apart.

8. The device connector of claim 1, wherein the water drainage hole is arranged outside an entrance path of the seal member in the tubular portion by being provided on a part made wider than a part to be contacted by the seal member in the tubular portion.

9. The device connector of claim 1, wherein:

the tubular portion is mounted around the wire introducing portion with one upward opening, through which the wire introducing portion is to be accommodated; and the water drainage hole vertically penetrates through a bottom part of an enlarged diameter portion enlarged in diameter right above a part to be contacted by the seal member in the tubular portion.

10. The device connector of claim 1, wherein:

the tubular portion is mounted around the wire introducing portion with one upward opening, through which the wire introducing portion is to be accommodated; and the water drainage hole is open laterally along a bottom part of an enlarged diameter portion enlarged in diameter right above a part to be contacted by the seal member in the tubular portion.

* * * * *